US006694231B1

(12) United States Patent
Rezk

(10) Patent No.: US 6,694,231 B1
(45) Date of Patent: Feb. 17, 2004

(54) TRAIN REGISTRY OVERLAY SYSTEM

(75) Inventor: Nagy H. Rezk, Venetia, PA (US)

(73) Assignee: Bombardier Transportation GmbH, Berlin (DE)

( * ) Notice: Subject to any disclaimer, the term of this patent is extended or adjusted under 35 U.S.C. 154(b) by 0 days.

(21) Appl. No.: 10/214,837

(22) Filed: Aug. 8, 2002

(51) Int. Cl.[7] ..... B61L 25/02
(52) U.S. Cl. ..... 701/19
(58) Field of Search ..... 701/19, 117; 340/993; 342/44; 246/2 R, 27, 28 R

(56) References Cited

U.S. PATENT DOCUMENTS

| | | | | |
|---|---|---|---|---|
| 3,440,600 A | | 4/1969 | Frech et al. | |
| 4,007,897 A | | 2/1977 | Auer, Jr. | |
| 4,166,599 A | | 9/1979 | Auer, Jr. et al. | |
| 4,220,946 A | | 9/1980 | Henriot | |
| 4,361,301 A | | 11/1982 | Rush | |
| 4,763,267 A | | 8/1988 | Knight et al. | |
| 4,994,969 A | | 2/1991 | Petit | |
| 5,533,695 A | | 7/1996 | Heggestad et al. | |
| 5,623,413 A | | 4/1997 | Matheson et al. | |
| 5,740,046 A | | 4/1998 | Elestedt | |
| 5,803,411 A | | 9/1998 | Ackerman et al. | |
| 5,836,529 A | * | 11/1998 | Gibbs | 246/122 R |
| 5,947,423 A | * | 9/1999 | Clifton et al. | 246/62 |
| 6,144,901 A | | 11/2000 | Nickles et al. | |
| 6,195,023 B1 | | 2/2001 | Walsh et al. | |

* cited by examiner

*Primary Examiner*—Michael J. Zanelli
(74) *Attorney, Agent, or Firm*—Webb Ziesenheim Logsdon Orkin & Hanson, P.C.

(57) ABSTRACT

A train registry system is overlaid upon an existing automatic train protection system and operates simultaneously with the automatic train protection system to collect redundant information that may be utilized in the event that the automatic train protection system computer and backup computer must be restarted or in the event a vehicle no longer communicates with the automatic train protection system computer. The train registry is comprised of a plurality of transponders mounted upon train vehicles and transponder readers mounted at wayside locations to extract information from vehicles and forward the information to the wayside computer.

12 Claims, 2 Drawing Sheets

TRAIN REGISTRY OVERLAY SYSTEM

BACKGROUND OF THE INVENTION

1. Field of the Invention

The invention relates to a back up recovery system used for a communication based train control (CBTC) system for determining the location, train identification numbers, and the total number of vehicles in the CBTC system.

2. Description of Related Art

Until recently, identifying the location of a train having one or more vehicles on a train track was an inexact science. The train track, or guideway, was divided into fixed sections known as blocks and once a particular train entered and occupied a block, no other trains could enter that block since the exact location of the occupying train was unknown within the occupied block.

The fixed blocks can vary in length from hundreds of feet to miles on a particular track. In many instances, this fixed block arrangement adversely affects a train's schedule by preventing a train from entering a block, even though it is a safe distance from the next closest train that happens to be located in that block. Recently, the concept of moving blocks has been implemented within the automatic train protection (ATP) system of a CBTC system. A moving block system is a dynamic system which creates an imaginary space, or train envelope, that automatically moves along with a particular train as that train travels along a track such that no other train may enter that imaginary space. The length of the moving block depends on various characteristics, such as train speed, train acceleration/deceleration rates and braking ability. A simple example of a moving block is a train envelope which extends 100 feet in front of, and fewer feet behind a particular train. Exchange of data between the train and at least one wayside computer through regular train-to-wayside communication enables processors and controllers to determine the appropriate safe separation between trains. Safe train separation can be continuously calculated, and this separation defines the moving block that moves along with the train. The length of the moving block varies as the operating parameters of the train change.

While the moving block system is more efficient than the fixed block system, it is imperative in the moving block system that a train onboard computer communicates with one or more wayside computers to determine for each train at least the train identification number, the number of vehicles in the train configuration, the train location in the CBTC system, and the train speed. Based on the collected data from the trains, the wayside computers must be able to determine the total number of communicating trains within each region. In the event one or more trains stop communicating with the wayside computers, then critical information about those trains becomes unavailable, thereby causing the system to place a prohibit block or default train envelope around each non-communicating train. That results in time consuming remedial efforts to remove the default train envelope around each non-communicating train. Similar problems may exist, but on a bigger scale, when the prohibit blocks cover the entire system. This may occur during cold startup of primary and secondary wayside computers thus preventing all the trains from operating in an automatic mode. During a cold startup process, the wayside computers have no knowledge of the train identifications, locations, or their operating information.

In the past, for relatively fast recovery of the ATP system caused by one or more non-communicating trains, simultaneous multiple common mode failures or software failures, an underlay fixed type block system was implemented. This is a secondary (backup) system that works in the background, while the CBTC system is operating normally. Train detection mechanisms, such as track circuits, wheel detectors, and axle counters are the most common currently used technologies in these secondary systems. However, each of these require the installation of new equipment and such an undertaking may be expensive and time consuming to the point of reducing the benefits and time savings of the communication based train control system.

In the absence of these backup mechanisms, recovery of the moving block system may be costly and time consuming. Since the geographical system layout and size as well as the total number of operating trains have a direct proportional impact on the cost and recovery time, this is particularly significant for medium and large systems. One recovery method requires the wayside computers to poll all of the operating vehicles in the system based upon the last-known set of data prior to the system malfunction. However, it is entirely possible that during the course of this malfunction trains could be added, removed or relocated between a system main guideway and a yard (Maintenance and Storage Facility or M&SF) within the system, such that the memory of the wayside computers is entirely inaccurate. Under these circumstances, the central control operator would have to dispatch train operators to drive the affected trains in a manual sweep mode in which the speed limit is usually under 10 miles per hour, until all prohibit blocks placed by the system are removed as the manually driven trains traverse them. In a sense, this is like surveying the tracks in the entire system to identify the existence of vehicles and determine whether or not all the trains were indeed communicating with a wayside computer. If a vehicle/train was not communicating with a wayside computer, that vehicle must be removed from the system.

Furthermore, in order to accurately update the data in the wayside computer and reestablish communication between the communicating trains and wayside computers, it is necessary to move each communicating train past an initialization area using wayside sensors to detect train movements. However, since the wayside computers are not fully recovered, the system must operate in an unprotected, manual mode whereby the trains cannot be moved faster than 5–10 miles per hour until all segment blocks are cleared. Once all of the blocks have been cleared, the system is restored to full automatic operation. While this method is reliable, depending on the system size and number of recovered trains, it may take a number of hours and a large recovery crew to implement. As a result, the overall efficiency of the ATP system may be reduced.

A system is needed that, in the event of a wayside computer cold startup where it is necessary to detect non-communicating train movement within the blocks of a series of blocks defining a region, will promote recovery of an ATP system, in a timely fashion.

While a particular ATP system has been described, it should be appreciated there are many different types of ATP systems and expedited recovery of these ATP systems is needed in the event of a malfunction or failure of the ATP system.

SUMMARY OF THE INVENTION

One embodiment of the invention is directed to a train registry associated with a railway track system for providing detection of trains having vehicles within the system to assist in startup or failure recovery of an automated train protection subsystem in a communications based train control system. The track system has a main guideway and the train registry comprises:

a) a wayside computer for receiving and interpreting base data to determine at least i) the location, within one of a plurality of predefined zones within the system, of each train; ii) the identification of vehicles of each train within the system; and iii) the total number of trains in the system;

b) at least one transponder positioned on each train vehicle in the system, wherein each transponder contains at least the identification of the train vehicle with which it is associated; and c) transponder readers positioned at a plurality of wayside locations, or registration points, along the guideway for polling the transponders on each train vehicle when they are proximate to the reader to determine the location and the identification of each train vehicle and to forward this base data to the wayside computer.

Another embodiment of the subject invention is directed to a method for streamlining startup or failure recovery of an automatic train protection subsystem in a communications based train control system for a railway track system having a track and trains with vehicles thereon. The method comprises the steps of:

a) positioning a plurality of transponder readers throughout the track system along the track;

b) mounting upon each train vehicle at least one transponder capable of providing to each reader the train vehicle identification;

c) moving each train vehicle past at least one transponder reader such that the train transponder transmits at least the train vehicle identification to the respective reader;

d) with the identification information for each train vehicle and the location of the transponder reader identifying each train vehicle, determining at least i) the location, within one of a plurality of predefined zones within the system, of each train; ii) the identification of each train vehicle within the system; and iii) the total number of train vehicles in the system; and e) at the time of startup or failure recovery of the train protection system, providing base data including the identification of each train vehicle, the total number of train vehicles in each zone and the zone in which each train vehicle is located to the train protection subsystem, thereby providing initialization information to the train protection subsystem.

DETAILED DESCRIPTION OF THE INVENTION

The invention is directed to a train registry which overlays an existing communication based train control (CBTC) system to provide limited redundant information about vehicles within a train network, thereby enabling a communication based train protection system, when the data in the system is compromised, to recover in an expedited fashion.

Preferably, the train registry in accordance with the subject invention should operate completely independent of the ATP system. However, in certain circumstances, it may be acceptable to utilize at least some common equipment with the ATP subsystem. Generally speaking, the train registry utilizes at least one transponder positioned on each vehicle of a train in a railway track system and a plurality of transponder readers positioned at various wayside locations. This arrangement is opposite to that of a typical ATP system which utilizes a plurality of transponders positioned at wayside locations and a plurality of transponder readers positioned on each train in the network.

Figure 1:
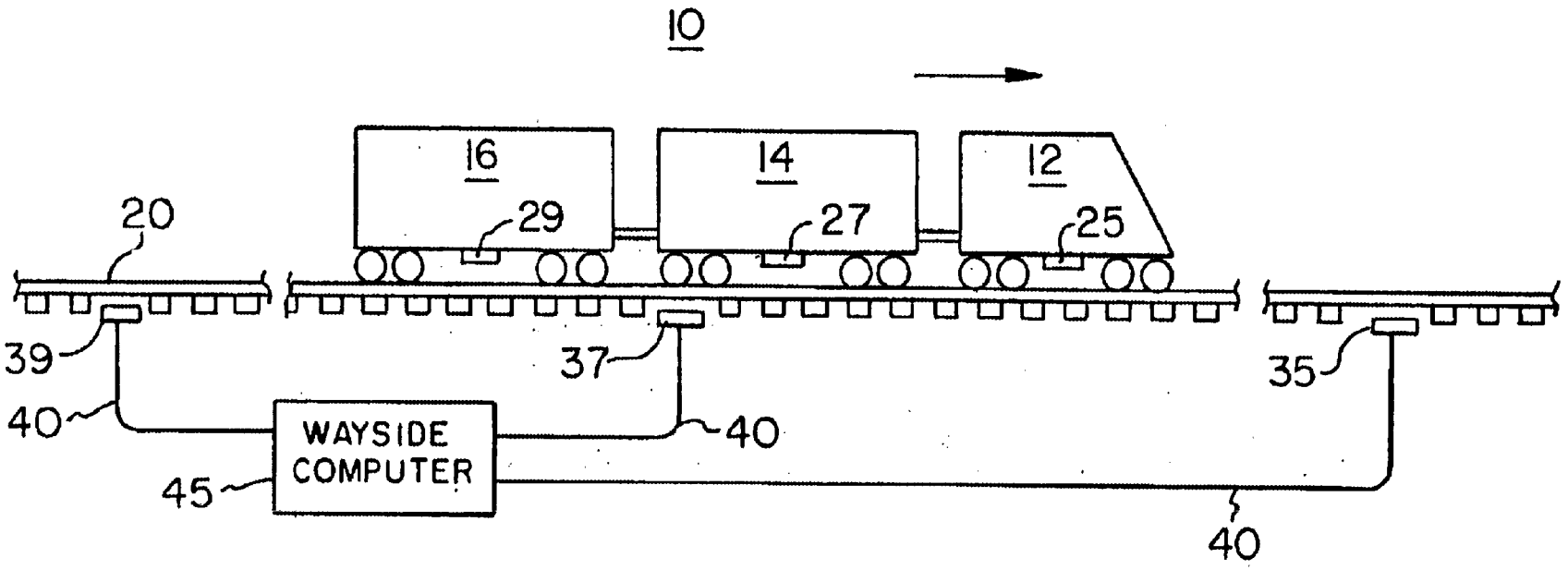
FIG. 1 illustrates a schematic of the arrangement whereby transponders are mounted to typical vehicles of a train and communicate with wayside readers to determine various base data of the associated train.

Directing attention to FIG. 1, a train 10 having associated with it vehicles 12, 14, 16 positioned upon a vehicle track 20 has mounted upon it at least one transponder 25 that may be in the form of an intelligent RF tag. It is preferred that each vehicle 12, 14, 16 on a train 10 have a transponder and such transponders are indicated as 25, 27, 29 on vehicles 12, 14, 16, respectively. At key positions along the wayside of the vehicle track 20, transponder readers 35, 37, 39 are positioned. The transponder readers 35, 37, 39 may be selectively located along the track 20 to create fixed zones Z1 and Z2. Any number of zones may be defined by using additional transponder readers. The spacing between transponder readers may vary depending upon the desired size of any particular zone. As an example, small zones may be defined around switch tracks.

In operation, when the transponder 25 on the vehicle 12 is proximate to the transponder reader 37 along the vehicle track 20, base data is communicated from the vehicle transponder 25 to the transponder reader 37, where it is then forwarded through communication link 40 to a wayside computer 45. The transponder 25 provides to the transponder reader 37 base data, including the location of each vehicle 12, 14, 16 by respective zone on the track 20 and the identification of each vehicle. By performing a similar operation with other trains within the system, the total number of trains 10 within the system may be determined. Each time a vehicle 12 passes a wayside transponder reader 37, base data is transmitted to the wayside computer 45 through the communication link 40.

The train registry system operates simultaneously with, but in the background of, the ATP subsystem. In the event the integrity of the ATP subsystem is compromised, whether it occurs through the loss of communication with one or more vehicles 12, 14, 16 or in the rare event of both the primary and secondary ATP computers failing, then the base data of the train registry may be retrieved and utilized by the ATP subsystem to speed recovery and to verify the integrity of the ATP subsystem.

Figure 2:
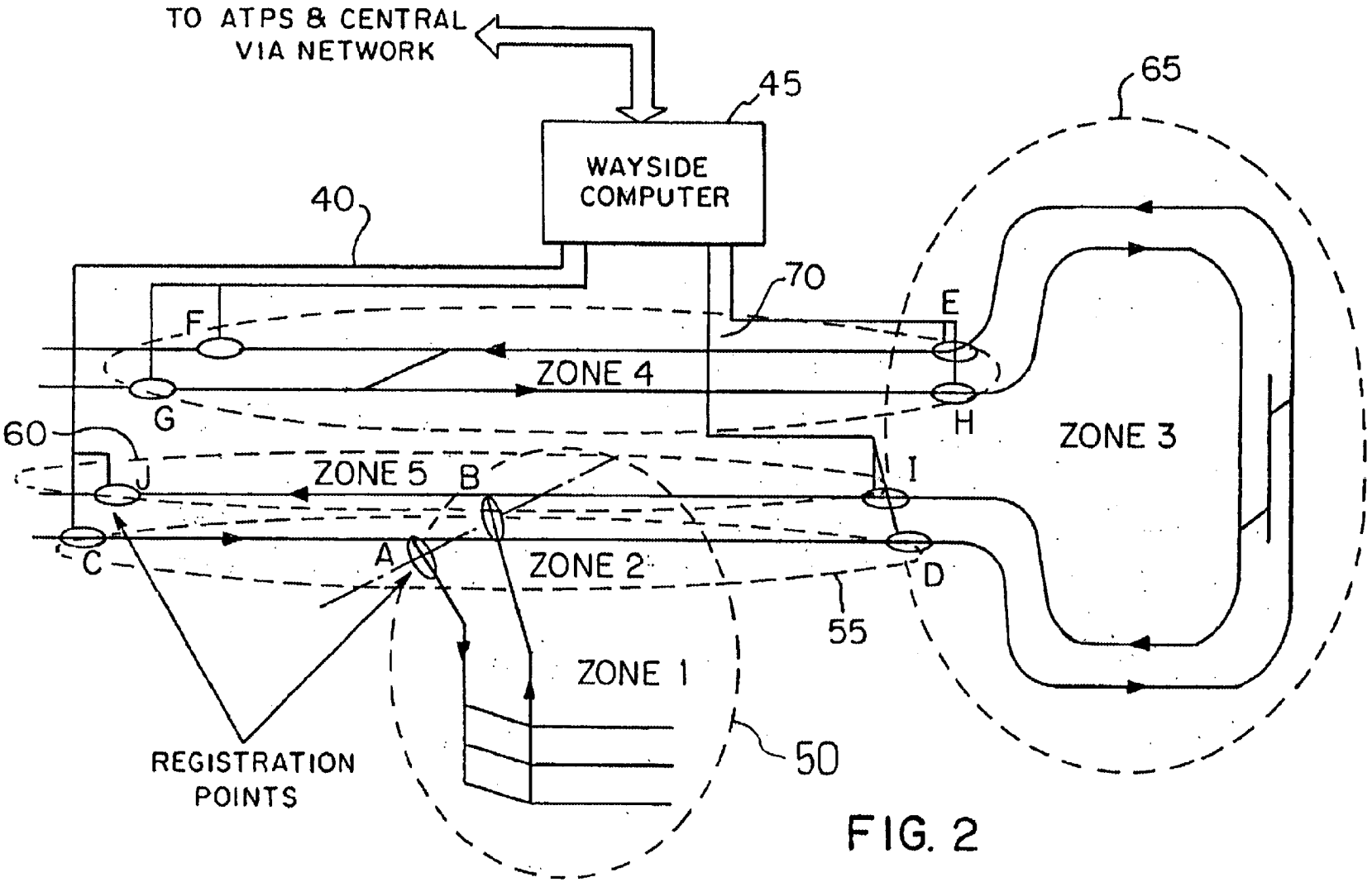
FIG. 2 illustrates a schematic of an existing train network retrofitted with the necessary hardware to implement the train registry in accordance with the subject invention.

FIG. 2 illustrates a typical train network system utilizing the train registry. However, the train 10, including vehicles 12, 14, 16, illustrated in FIG. 1, is not included in this schematic. It should be appreciated, however, that the train vehicle 10, or a similar vehicle, may travel on any of the vehicle tracks 20 available in the system. As will be discussed, detection mechanisms are in place throughout the system such that base data about each train vehicle 10 should be known by the wayside computer 45 which communicates directly with the ATP computer.

FIG. 2 illustrates, among other things, a maintenance and storage facility (M&SF), indicated by the encircled area reference number 50 and labeled as Zone 1, having registration points A, B at the point where the M&SF track intersects with the track of the main guideway. Each registration point A, B indicates a wayside location where at least one transponder reader is located. A plurality of registration points is positioned throughout the network to extract base data from the transponder on each vehicle for a comprehensive overview of vehicles in the train network. Through the selective positioning of registration points, a plurality of zones may be defined in the network. As illustrated in FIG. 2, registration points are positioned to define Zones 1–5. The positioning of registration points depends upon the importance of having data on vehicles that may be resident on a portion of the track in the network. While Zone 1, labeled 50, defines the region of the M&SF, Zone 2 is defined by registration points C and D and indicated by the encircled area labeled 55, and Zone 5 is defined by registration points I and J and indicated by the encircled area labeled 60. Zone 2 and Zone 5 exist to closely monitor the activity of vehicles in and out of the M&SF Zone 1. Additionally, Zone 3, defined by registration points D, E, H and I and identified by the encircled area labeled 65, covers a pair of tracks, while Zone 4, defined by registration points E, F, G and H, and identified by the encircled area labeled 70, also covers a pair of tracks. In a typical communication based vehicle positioning reference system, each vehicle has its own transponder reader which polls transponders along the wayside to determine the vehicle's exact location within the network. This location is then independently transmitted by the vehicle computer to the ATP system primary and secondary computers.

In the event the ATP subsystem primary and secondary computers are not functioning, it is still likely that there will be activity within the train network, such as vehicles being added to or taken from the main guideway through the M&SF, or vehicles being moved to different locations within the network. The ATP computer may or may not have base data representative of the system at the time the ATP computer became inoperative, however, the ATP computer will not have any knowledge of the interim activity that may have occurred from the time of this event to the time of startup. It is at this time of startup that the base data from the train registry is crucial.

Through the plurality of registration points A–J, defining a plurality of Zones 1–5, at any point in time the train registry should know base data about each vehicle, including i) the total number of train vehicles operating on the track, ii) the location within a zone of each vehicle on the track; and iii) the identification of each vehicle on the track. Preferably, compilation of this information is performed completely independent of any hardware or software associated with the ATP subsystem. As a result, this independent base data may be compared with the current data within the ATP computer and, in the event there are no inconsistencies between this base data and the data in the ATP computer, the ATP computer may resume normal operation.

When both ATP computers (primary and secondary) fail, and regardless of the amount of time they are inoperative, upon a cold startup, the wayside computer base data information comes into play.

When the ATP computer reboots, it independently tries to poll and establish communications with all vehicles to establish base data. The ATP computer also requests base data from the wayside computer. The base data from the ATP computer will then be cross-compared with the collected base data from the wayside computer and, after the comparison is performed, one of the following scenarios will take place.

If the base data independently collected by the ATP computer from polling trains matches the base data provided by the wayside computer, then there is a positive confirmation that all of the vehicles within the system are communicating. After a final confirmation by the central control operator that all trains are identified and communicating, then the vehicle track is clear for automatic operation and the ATP computer can now resume automatic operation.

If the ATP computer was able to communicate with more trains than those confirmed by the wayside computer, then the ATP computer may proceed with a conservative approach by assuming the worst case condition in which there are actually more vehicles than those recorded by the wayside computer. Under these circumstances, the ATP computer information is considered to be valid data and automatic operation will proceed based upon identification of the higher number of vehicles, while the train registry system will be checked to determine the reason for the discrepancy in the number of vehicles.

In the event the ATP computer communicated with fewer vehicles than those confirmed by the wayside computer, then it must be assumed that there are additional vehicles beyond those identified by the ATP computer and the missing vehicle(s) must be identified and either repaired or removed from the system. In a preferred embodiment of the invention, the train registry overlay system may utilize a vital design. In particular, such a vital system will guarantee within the required probability that there will be no undetected non-communicating vehicles in the system. However, based on the system design, contact requirements, operational procedures, and customer preferences, less conservative approaches may be adequate.

In order to improve the reliability of the system, it is possible to include redundant hardware. Such examples of redundant hardware may include redundant tag readers, greater or less resolution of fixed zones, and redundant transponders on each vehicle. Additionally, the train registry design may include two redundant wayside computers with vital communication links to the ATP subsystem. It is further possible to incorporate track circuits and/or trip stops on critical locations, such as yard entry/exit and zone boundaries.

Briefly returning to FIG. 1, the transponders 25, 27, 29 positioned on each vehicle 12, 14, 16 may be an intelligent tag, while the transponder readers 35, 37, 39 positioned at a wayside location, may be an intelligent tag reader. Furthermore, the communication link 40 between each transponder reader 35, 37, 39 and the wayside computer 45 may be an RS-485 serial communication link.

What has been described is a redundant system that may be overlaid upon an existing ATP subsystem such that, when the integrity of the ATP subsystem is compromised, whether it be through a non-communicating vehicle or the shutdown of the ATP computers, then the base data available through the train registry overlay system may be made available to the ATP computers, thereby greatly enhancing recovery of the ATP computer in a short period of time with a high level of confidence. As previously mentioned, the ATP system described herein is only one type of system that may benefit from the subject invention. Any train operating system that uses similar data as the ATP system described herein may benefit from the train registry described herein.

Throughout this discussion the vehicles have been described as travelling on tracks. It should be appreciated that the vehicles could also travel upon guideways and the term track was used only for convenience with the understanding that these terms may be used interchangeably and the scope of the subject invention extends to guideway systems as well as track systems.

While specific embodiments of the invention have been described in detail, it will be appreciated by those skilled in the art that various modifications and alternatives to those details could be developed in light of the overall teachings of the disclosure. The presently preferred embodiments described herein are meant to be illustrative only and not limiting as to the scope of the invention which is to be given the full breadth of the appended claims and any and all equivalents thereof.

The invention claimed is:

1. A train registry associated with a railway track system for providing detection of trains having vehicles within the system to assist in startup or failure recovery of an automated train protection subsystem in a communications based train control system, wherein the track system has a main guideway and wherein the train registry comprises:

a) a wayside computer for receiving and interpreting base data to determine at least i) the location, within one of a plurality of predefined zones within the system, of each train; ii) the identification of vehicles of each train within the system; and iii) the total number of trains in the system;

b) at least one transponder positioned on each train vehicle in the system, wherein each transponder contains at least the identification of the train vehicle with which it is associated; and c) transponder readers positioned at a plurality of wayside locations, or registration points, along the guideway for polling the transponders on each train vehicle when they are proximate to the reader to determine the location and the identification of each train vehicle and to forward this base data to the wayside computer.

2. The train registry according to claim 1 wherein at least one transponder is an intelligent tag and wherein at least one transponder reader is an intelligent tag reader.

3. The train registry according to claim 1 wherein the track network is comprised of a plurality of zones and each zone is defined by at least a pair of registration points.

4. The train registry according to claim 3 wherein the guideway includes a maintenance and storage facility and wherein one zone is defined by the maintenance and storage facility.

5. The train registry according to claim 4 further including a fail-safe checkpoint at the entrance to and exit from the maintenance and storage facility.

6. The train registry according to claim 1 further including a plurality of wayside computers, wherein each computer is dedicated to a predefined cluster of zones, and wherein each wayside computer communicates with the train protection system.

7. A method for streamlining startup or failure recovery of an automatic train protection subsystem in a communications based train control system for a railway track system having a track and trains with vehicles thereupon, wherein the method comprises the steps of:

a) positioning a plurality of transponder readers throughout the track system along the track;

b) mounting upon each train vehicle at least one transponder capable of providing to each reader the train vehicle identification;

c) moving each train vehicle past at least one transponder reader such that the train vehicle transponder transmits at least the train vehicle identification to the respective reader;

d) with the identification information for each train vehicle and the location of the transponder reader identifying each train vehicle, determining at least i) the location, within one of a plurality of predefined zones within the system, of each train vehicle; ii) the identification of each train vehicle within the system; and iii) the total number of train vehicles in the system; and e) at the time of startup or failure recovery of the train protection system, providing base data including the identification of each train vehicle, the total number of train vehicles in each zone and the zone in which each train vehicle is located to the train protection subsystem, thereby providing initialization information to the train protection subsystem.

8. The method according to claim 7 wherein the transponder readers are positioned within the system to define multiple zones.

9. The method according to claim 7 further including the step of comparing the base data against similar data retained in the train protection subsystem to validate or refute such data.

10. The method according to claim 9 wherein, in the event the step of comparing the base data indicates the data is valid, permitting the train protection system to return to normal operation.

11. The method according to claim 9 wherein, in the event the step of comparing the base data indicates fewer train vehicles in the system than those recorded by the train protection system, deferring to the train protection system data and returning the train protection system to normal operation.

12. The method according to claim 9 wherein, in the event the step of comparing the base data indicates more train vehicles in the system than those recorded by the train protection system, then suspending operation of the train protection system until the inconsistency can be remedied.

* * * * *